US011705055B2

(12) United States Patent
Li

(10) Patent No.: US 11,705,055 B2
(45) Date of Patent: Jul. 18, 2023

(54) DISPLAY DEVICE AND METHOD OF DRIVING THEREOF

(71) Applicant: TCL China Star Optoelectronics Technology Co., Ltd., Guangdong (CN)

(72) Inventor: Wenfang Li, Guangdong (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 302 days.

(21) Appl. No.: 17/255,505

(22) PCT Filed: Dec. 18, 2020

(86) PCT No.: PCT/CN2020/137447
§ 371 (c)(1),
(2) Date: Dec. 23, 2020

(87) PCT Pub. No.: WO2022/116284
PCT Pub. Date: Jun. 9, 2022

(65) Prior Publication Data

US 2022/0406241 A1 Dec. 22, 2022

(30) Foreign Application Priority Data

Dec. 1, 2020 (CN) ..... 202011392131.0

(51) Int. Cl.
*G09G 3/32* (2016.01)
*G09G 3/00* (2006.01)

(52) U.S. Cl.
CPC ..... *G09G 3/32* (2013.01); *G09G 3/006* (2013.01); *G09G 2330/028* (2013.01); *G09G 2330/12* (2013.01)

(58) Field of Classification Search
CPC ..... G09G 3/32; G09G 3/006; G09G 2330/12; G09G 2330/028
See application file for complete search history.

(56) References Cited

U.S. PATENT DOCUMENTS

| | | | | |
|---|---|---|---|---|
| 2011/0115770 | A1 | 5/2011 | Seo et al. | |
| 2015/0061981 | A1* | 3/2015 | Lee | G09G 3/3291 345/77 |
| 2015/0187273 | A1* | 7/2015 | Chang | G09G 3/3233 345/77 |
| 2019/0051250 | A1* | 2/2019 | Lee | G09G 3/3233 |

FOREIGN PATENT DOCUMENTS

| | | |
|---|---|---|
| CN | 1885376 | 12/2006 |
| CN | 102682721 | 9/2012 |
| CN | 103021346 | 4/2013 |
| CN | 103310753 | 9/2013 |
| CN | 103400553 | 11/2013 |
| CN | 103606354 | 2/2014 |

(Continued)

*Primary Examiner* — Muhammad N Edun

(57) ABSTRACT

The present disclosure provides a display device. The display device includes at least one display panel including at least one light-emitting diode (LED) light board, a drive control module connected to the LED light board, and a detecting module respectively connected to the LED light board and the drive control module. The LED light board includes at least one LED. The drive control module is configured to drive the LED of the LED light board to display.

14 Claims, 4 Drawing Sheets

(56) References Cited

FOREIGN PATENT DOCUMENTS

| | | |
|---|---|---|
| CN | 104008735 | 8/2014 |
| CN | 104361859 | 2/2015 |
| CN | 104505034 | 4/2015 |
| CN | 104700811 | 6/2015 |
| CN | 204423880 | 6/2015 |
| CN | 106205504 | 12/2016 |
| CN | 106548751 | 3/2017 |
| CN | 107610655 | 1/2018 |
| CN | 107750076 | 3/2018 |
| CN | 110148380 | 8/2019 |
| CN | 110767170 | 2/2020 |
| KR | 10-2017-0003226 | 1/2017 |
| TW | 201340073 | 10/2013 |
| TW | 1657423 | 4/2019 |

* cited by examiner

DISPLAY DEVICE AND METHOD OF DRIVING THEREOF

RELATED APPLICATIONS

This application is a National Phase of PCT Patent Application No. PCT/CN2020/137447 having International filing date of Dec. 18, 2020, which claims the benefit of priority of Chinese Patent Application No. 202011392131.0 filed on Dec. 1, 2020. The contents of the above applications are all incorporated by reference as if fully set forth herein in their entirety.

FIELD AND BACKGROUND OF THE INVENTION

The present disclosure relates to the field of display technologies, and particularly to a display device and a method of driving the display device.

In recent years, mini light-emitting diodes (mini-LEDs) have been widely used in backlight sources of display devices because of their ability to realize ultra-thinness and multi-zone functions.

At present, in order to meet brightness and power requirements at room temperature, many mini-LED display devices choose constant voltage to drive the mini-LEDs to display. But during a display process, the mini-LEDs will generate heat as a display time of the mini-LEDs increases, and because mini-LED lamps have an electrical property that a current passing through the mini-LED lamps in an existing display device will increase at high temperatures, leading to a power surge of the mini-LED, which affects the use of the mini-LED display devices.

SUMMARY OF THE INVENTION

The present disclosure provides a display device and a method for driving the display device to a technical problem that the current of the mini-LED lamp beads in an existing display device will increase at a high temperature, leading to a power surge of the mini-LED.

To solve the above technical problems, the technical solutions provided by the disclosure as follows.

The disclosure provides a display device, including:

at least one display panel, wherein the display panel includes at least one LED light board, and the LED light board includes at least one LED;

a drive control module connected to the LED light board, wherein the drive control module is configured to drive the LED of the LED light board to display; and a detecting module respectively connected to the LED light board and the drive control module.

Wherein the drive control module is configured to drive the LED of the LED light board to display, the detecting module is configured to detect a real-time current flowing through the LED, and the drive control module is configured to switch display modes of the LED light board according to a magnitude of the real-time current to keep the real-time current within a threshold current range.

In the display device provided by an embodiment of the present disclosure, the display modes of the LED light board comprise a high-grayscale regular display mode and a low-grayscale cooling display mode;

a step of the drive control module switching the display modes of the LED light board according to the magnitude of the real-time current includes:

when the real-time current is greater than a first threshold current, the drive control module driving the LED light board to display in the low-grayscale cooling display mode; and when the real-time current is less than a second threshold current, the drive control module driving the LED light board to display in the high-grayscale regular display mode;

wherein the first threshold current is greater than or equal to the second threshold current, the first threshold current is less than a maximum value of the threshold current range, and the second threshold current is less than a minimum value of the threshold current range.

In the display device provided by an embodiment of the present disclosure, the detecting module includes a detecting resistor connected to the LED, the drive control module is connected to two opposite ends of the detecting resistor, and the drive control module is configured to receive a real-time voltage generated by the real-time current at the two opposite ends of the detection resistor, and to switch the display modes of the LED light board according to the magnitude of a real-time voltage.

In the display device provided by an embodiment of the present disclosure, a step of the drive control module receiving a real-time voltage generated by the real-time current at the two opposite ends of the detection resistor, and switching the display modes of the LED light board according to the magnitude of the real-time voltage includes:

when the real-time voltage is greater than a first threshold voltage, and the real-time current corresponding to the real-time voltage is greater than the first threshold current, the drive control module driving the LED light board to display in the low-grayscale cooling display mode; and when the real-time voltage is less than a second threshold voltage, and the real-time current corresponding to the real-time voltage is less than the second threshold current, the drive control module driving the LED light board to display in the high-grayscale regular display mode;

wherein the first threshold voltage is greater than or equal to the second threshold voltage, the first threshold voltage matches with the first threshold current, and the second threshold voltage matches with the second threshold current.

In the display device provided by an embodiment of the present disclosure, the drive control module includes a drive chip and a comparison module connected to the detecting resistor and the drive chip respectively, the comparison module compares the real-time voltage with the first threshold voltage and the second threshold voltage to obtain a comparison result, and to transmit the comparison result to the drive chip.

In the display device provided by an embodiment of the present disclosure, the detecting module further includes an amplifier, the detecting resistor is connected to the comparison module by the amplifier, two opposite ends of the detecting resistor are respectively connected to two input terminals of the amplifier, and an output terminal of the amplifier is connected to the comparison module.

In the display device provided by an embodiment of the present disclosure, the first threshold voltage is equal to the second threshold voltage, the comparison module includes a comparator, an output terminal of the comparator is connected to the drive chip, a first input terminal of the comparator is connected to the output terminal of the amplifier, and the first threshold voltage or the second threshold voltage is input into a second input terminal of the comparator.

The disclosure further provides another display device, including:

a display panel including at least one LED light board, wherein the LED light board includes at least one LED;

a drive control module connected to the LED light board, wherein the drive control module is configured to drive the LED of the LED light board to display;

a detecting module respectively connected to the LED light board and the drive control module;

and a constant voltage control module connected to the LED light board;

wherein the detecting module is configured to detect a real-time current flowing through the LED, and the drive control module is configured to switch display modes of the LED light board according to a magnitude of the real-time current to keep the real-time current within a threshold current range.

In the display device provided by an embodiment of the present disclosure, display modes of the LED light board include a high-grayscale regular display mode and a low-grayscale cooling display mode, and a step of the drive control module switching a display mode of the LED light board according to the magnitude of the real-time current includes:

when the real-time current is greater than a first threshold current, the drive control module driving the LED light board to display in the low-grayscale cooling display mode; and when the real-time current is less than a second threshold current, the drive control module driving the LED light board to display in the high-grayscale regular display mode; and wherein the first threshold current is greater than or equal to the second threshold current, the first threshold current is less than a maximum value of the threshold current range, and the second threshold current is less than a minimum value of the threshold current range.

In the display device provided by an embodiment of the present disclosure, the detecting module includes a detecting resistor connected to the LED, the drive control module is connected to two opposite ends of the detecting resistor, and the drive control module is configured to receive a real-time voltage generated by the real-time current at the two opposite ends of the detection resistor, and to switch the display modes of the LED light board according to a magnitude of the real-time voltage.

In the display device provided by an embodiment of the present disclosure, a step of the drive control module receiving a real-time voltage generated by the real-time current at the two opposite ends of the detection resistor, and switching the display modes of the LED light board according to the magnitude of the real-time voltage, includes:

when the real-time voltage is greater than a first threshold voltage, and the real-time current corresponding to the real-time voltage is greater than the first threshold current, the drive control module driving the LED light board to display in the low-grayscale cooling display mode;

and when the real-time voltage is less than a second threshold voltage, and the real-time current corresponding to the real-time voltage is less than the second threshold current, the drive control module driving the LED light board to display in the high-grayscale regular display mode; and wherein the first threshold voltage is greater than or equal to the second threshold voltage, the first threshold voltage matches with the first threshold current, and the second threshold voltage matches with the second threshold current.

In the display device provided by an embodiment of the present disclosure, the drive control module includes a drive chip and a comparison module connected to the detecting resistor and the drive chip respectively, the comparison module is configured to compare the real-time voltage with the first threshold voltage and the second threshold voltage to obtain a comparison result, and to transmit the comparison result to the drive chip.

In the display device provided by an embodiment of the present disclosure, the detecting module further includes an amplifier, the detecting resistor is connected to the comparison module by the amplifier, two opposite ends of the detecting resistor are respectively connected to two input terminals of the amplifier, and an output terminal of the amplifier is connected to the comparison module.

In the display device provided by an embodiment of the present disclosure, the first threshold voltage is equal to the second threshold voltage, the comparison module includes a comparator, an output terminal of the comparator is connected to the drive chip, a first input terminal of the comparator is connected to the output terminal of the amplifier, and the first threshold voltage or the second threshold voltage is input into a second input terminal of the comparator.

The disclosure further provides a method of driving a display device. The display device includes:

a display panel including at least one LED light board, wherein the LED light board includes at least one LED;

a drive control module connected to the LED light board, wherein the drive control module is configured to drive the LED of the LED light board to display; and a detecting module respectively connected to the LED light board and the drive control module;

the method of driving the display device includes:

detecting a real-time current flowing through the LED by the detecting module; and switching display modes of the LED light board according to a magnitude of the real-time current to keep the real-time current within a threshold current range by the drive control module.

In the method provided by an embodiment of the present disclosure, the display modes of the LED light board include a high-grayscale regular display mode and a low-grayscale cooling display mode; a step of switching the display mode of the LED light board according to the magnitude of the real-time current by the drive control module includes:

when the real-time current is greater than a first threshold current, the drive control module driving the LED light board to display in the low-grayscale cooling display mode; and when the real-time current is less than a second threshold current, the drive control module driving the LED light board to display in the high-grayscale regular display mode;

wherein the first threshold current is greater than or equal to the second threshold current, the first threshold current is less than a maximum value of the threshold current range, and the second threshold current is less than a minimum value of the threshold current range.

In the method provided by an embodiment of the present disclosure, the detecting module includes a detecting resistor connected to the LED, the drive control module is connected to two opposite ends of the detecting resistor, and the drive control module is configured to receive a real-time voltage generated by the real-time current at the two opposite ends of the detection resistor, and to switch the display modes of the LED light board according to a magnitude of the real-time voltage;

a step of the drive control module receiving a real-time voltage generated by the real-time current at the two opposite ends of the detection resistor, and switching the display modes of the LED light board according to the magnitude of the real-time voltage, includes:

when the real-time voltage is greater than a first threshold voltage, and the real-time current corresponding to the real-time voltage is greater than the first threshold current, the drive control module driving the LED light board to display in the low-grayscale cooling display mode; and when the real-time voltage is less than a second threshold voltage, and the real-time current corresponding to the real-time voltage is less than the second threshold current, the drive control module driving the LED light board to display in the high-grayscale regular display mode;

wherein the first threshold voltage is greater than or equal to the second threshold voltage, the first threshold voltage matches with the first threshold current, and the second threshold voltage matches with the second threshold current.

In the display device of the present disclosure, the present application detects the real-time current flowing through the LED through the detection module, and switches the display modes of the LED light board according to the magnitude of the real-time current through the drive control module, so that the real-time current is kept within a threshold current range, which avoids the real-time current flowing through the LED caused by high temperature being excessive, and leading to a power surge of the mini-LED.

BRIEF DESCRIPTION OF THE SEVERAL VIEWS OF THE DRAWINGS

In order to explain embodiments or technical solutions in the prior art more clearly, the following will briefly introduce drawings involved in a following description of the embodiments or the prior art. Obviously, the drawings in the following description are merely inventions. Those of ordinary skill in the art can obtain other drawings based on these drawings without creative work.

DESCRIPTION OF SPECIFIC EMBODIMENTS OF THE INVENTION

Reference will now be made in detail to embodiments, examples of which are illustrated in the accompanying drawings. In description of the disclosure, it should be understood that orientational relationships represented by directional terms mentioned in the present disclosure, such as up, down, front, rear, left, right, inside, outside, side surface, etc., are orientational relationships based on the drawings, and are merely for the convenience of describing the present disclosure and simplifying the description, and should not be interpreted as a limitation of the application. Wherein, same or similar reference numbers always represent same or similar elements or elements with same or similar functions.

In addition, terms such as "first" and "second" are used herein for purposes of description and should not be interpreted as indication or implication of relative importance, or implied indication of a number of the technical features. Therefore, features limited by terms such as "first" and "second" can explicitly or impliedly include one or more than one of these features. In description of the disclosure, "a plurality of" means two or more than two, unless otherwise specified.

In description of the present disclosure, it should be understood that, unless specified or limited otherwise, the terms "mounted", "connected" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

The technical solution of the present disclosure will now be described in conjunction with specific embodiments.

At present, in order to meet brightness and power requirements at room temperature, many mini light-emitting diode (mini-LED) display devices choose constant voltage to drive the mini-LEDs to display. But during a display process, the mini-LEDs will generate heat as a display time of the mini-LEDs increases, and because mini-LED lamps have an electrical property that a current passing through the mini-LED lamps in an existing display device will increase at high temperatures, leading to a power surge of the mini-LED, which affects the use of the mini-LED display device. The present disclosure provides a display device based on the above technical problems, and the specific solution is as follows.

Figure 1:
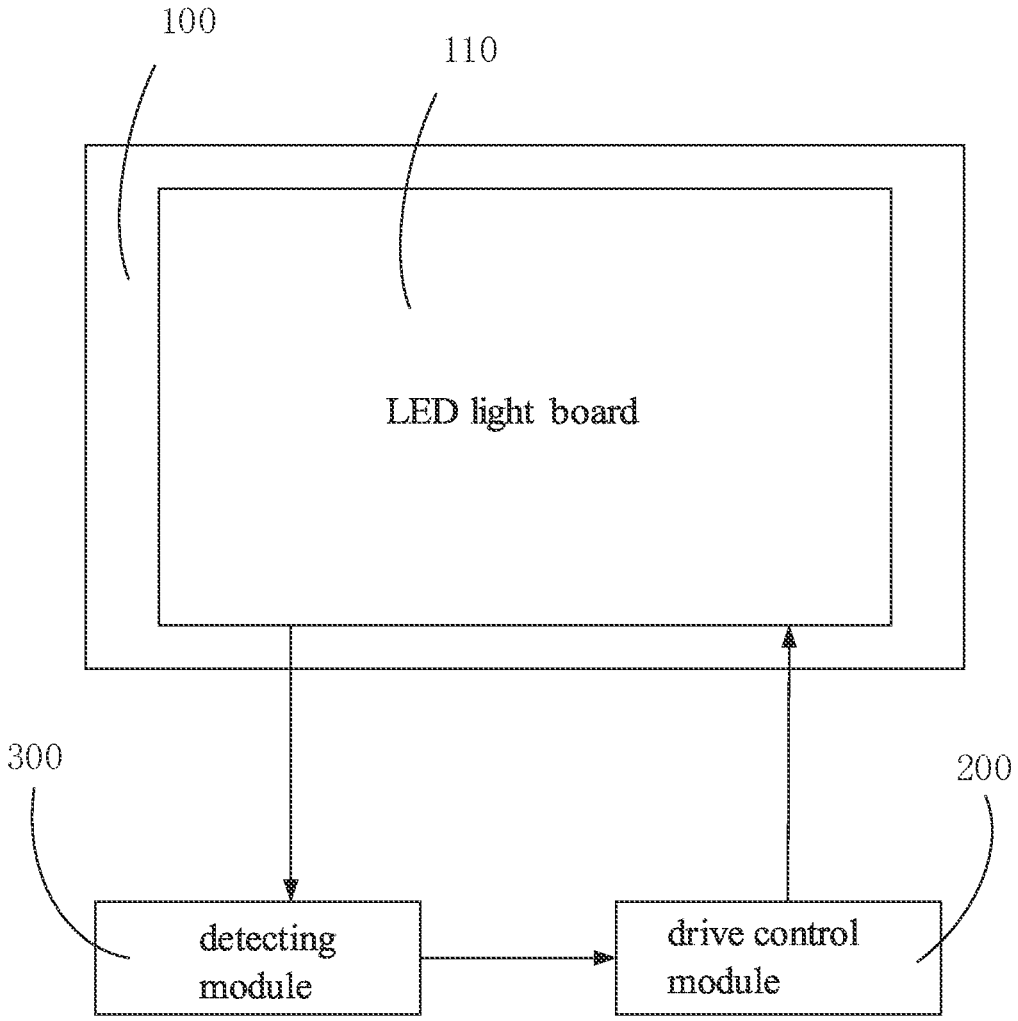
FIG. 1 is a schematic view of a display device according to a first embodiment of the present disclosure.

Please refer to FIG. 1, FIG. 1 shows a display device. The display device includes:

a display panel 100, wherein the display panel 100 includes at least one light-emitting diode (LED) light board 110, and the LED light board 110 includes at least one LED (not shown in the FIG. 1);

a drive control module 200 connected to the LED light board 110, wherein the drive control module 200 is configured to drive the LED of the LED light board 110 to display; and a detecting module 300 respectively connected to the LED light board 110 and the drive control module 200, wherein the detecting module 300 is configured to detect a real-time current flowing through the LED, and the drive control module 200 is configured to switch display modes of the LED light board 110 according to a magnitude of the real-time current to keep the real-time current within a threshold current range. It can be understood that the display device can further include a constant voltage control module connected to the LED light board 110. The constant voltage control module is configured to make the LED light board 110 to display under a constant voltage. Specifically, the constant voltage may be set to 24V. The LED light board 110 may include a plurality of LEDs arranged in an array. Specifically, the detecting module 300 may be connected to an output terminal of the LED or be connected to a drive circuit driving the LED to detect the real-time current flowing through the LED. In addition, the threshold current range may be defined according to actual needs and will not be repeated here. In an embodiment of this disclosure, the display device detects the real-time current flowing through the LED by the detecting module 300 and switches display modes of the LED light board 110 according to the magnitude of the real-time current by the drive control module 200 to keep the real-time current within a threshold current range, which avoids the real-time current flowing through the LED caused by high temperature being excessive and leading to a power surge of the mini-LED.

In an embodiment of this disclosure, as shown in FIG. 1, the display modes of the LED light board 110 include a high-grayscale regular display mode and a low-grayscale cooling display mode.

A step of the drive control module 200 switching the display modes of the LED light board 110 according to the magnitude of the real-time current includes:

when the real-time current is greater than a first threshold current, the drive control module 200 driving the LED light board 110 to display in the low-grayscale cooling display mode; and when the real-time current is less than a second threshold current, the drive control module 200 driving the LED light board 110 to display in the high-grayscale regular display mode;

wherein the first threshold current is greater than or equal to the second threshold current, the first threshold current is less than a maximum value of the threshold current range, and the second threshold current is less than a minimum value of the threshold current range.

It can be understood that the display modes of the LED light board 110 includes the high-grayscale regular display mode and the low-grayscale cooling display mode. The high-grayscale regular display mode is a normal display mode. When the real-time current is greater than a first threshold current, the drive control module 200 drives the LED light board 110 to display in the low-grayscale cooling display mode, which can reduce an output power of the LED light board 110 and the real-time current flowing through the LED to keep the real-time current within a threshold current range. Keeping the real-time current within the threshold current range can prevent a temperature of the LED from increasing continuously and make the LED achieve a certain cooling effect. Obviously, when the temperature of the LED is reduced to a threshold temperature, i.e., the real-time current is less than the second threshold current, the drive control module 200 drives the LED light board 110 to display in the high-grayscale regular display mode, thereby, the LED light board 110 return to a normal display mode. In an embodiment of this disclosure, the high-grayscale regular display mode may be displayed with 64 grayscales, and the low-grayscale cooling display mode may be displayed with 60 grayscales.

As mentioned above, in an embodiment of this disclosure, the first threshold current is greater than or equal to the second threshold current, the first threshold current is less than a maximum value of the threshold current range, and the second threshold current is less than a minimum value of the threshold current range. It can be understood that because the first threshold current is less than the maximum value of the threshold current range, the drive control module 200 can switch the display modes of the LED light board 110 before the real-time current becomes greater than the maximum value of the threshold current range, to reduce the temperature of the LED and prevent the temperature of the LED from increasing continuously. And because the second threshold current is less than the minimum value of the threshold current range, the drive control module 200 can switch the display modes of the LED light board 110 before the real-time current becomes less than the minimum value of the threshold current range, to prevent the display mode of the LED light board 110 from being kept at the low-grayscale cooling display mode and reducing display quality.

Figure 2:
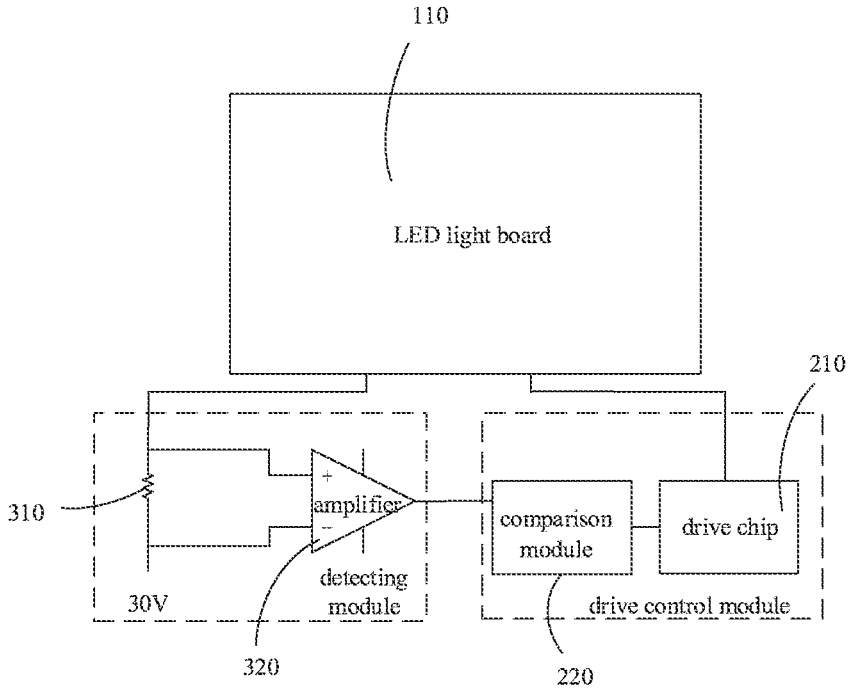
FIG. 2 is a schematic view of a display device according to a second embodiment of the present disclosure.

In an embodiment of this disclosure, please refer to FIG. 2, the detecting module 300 includes a detecting resistor 310 connected to the LED. The drive control module 200 is connected to two ends of the detecting resistor 310. The drive control module 200 is configured to receive a real-time voltage generated by the real-time current at the two ends of the detection resistor 310, and to switch the display modes of the LED light board 110 according to a magnitude of the real-time voltage. That is, one end of the detection resistor 310 is connected to the LED, and the other end of the detection resistor 310 is connected to a voltage-regulator element or a voltage-regulator terminal. In an embodiment of this disclosure, a voltage of the voltage-regulator element or the voltage-regulator terminal is 30V. When the real-time current increases, the real-time voltage across the detection resistor 310 increases. Obviously, the real-time current can be determined by detecting the real-time voltage across the detection resistor 310. Therefore, the drive control module 200 can switch the display modes of the LED light board 110 according to the magnitude of the real-time voltage across the detection resistor 310.

As mentioned above, a step of the drive control module 200 receiving the real-time voltage across the detection resistor 310 and switching the display modes of the LED light board 110 according to the magnitude of the real-time voltage across the detection resistor 310 includes:

when the real-time voltage is greater than a first threshold voltage and the real-time current corresponding to the real-time voltage is greater than the first threshold current, the drive control module 200 driving the LED light board 100 to display in the low-grayscale cooling display mode; and when the real-time voltage is less than a second threshold voltage and the real-time current corresponding to the real-time voltage is less than the second threshold current, the drive control module 200 driving the LED light board 110 to display in the high-grayscale regular display mode, wherein the first threshold voltage is greater than or equal to the second threshold voltage, the first threshold voltage matches with the first threshold current, and the second threshold voltage matches with the second threshold current.

It can be understood that the magnitude of the real-time current can be obtained by detecting the magnitude of the real-time voltage. Therefore, the magnitude of the first threshold voltage can be correspondingly set according to the magnitude of the first threshold current and thus, when the real-time voltage is greater than the first threshold voltage, and the real-time current corresponding to the real-time voltage is greater than the first threshold current, the drive control module 200 can switch the LED light board 110 to display in the low-grayscale cooling display mode, which can reduce an output power of the LED light board 110 and the real-time current flowing through the LED to keep the real-time current within a threshold current range. The real-time current being kept within a threshold current range can prevent a temperature of the LED from increasing continuously, and make the LED achieve a certain cooling effect. When the temperature of the LED is reduced to a threshold temperature, the real-time voltage is less than a second threshold voltage, and the real-time current corresponding to the real-time voltage is less than the second threshold current, the drive control module 200 drives the LED light board 110 to display in the high-grayscale regular display mode, thereby returning the LED light board 110 return to a normal display mode.

In an embodiment of this disclosure, please refer to FIG. 2, the drive control module 200 includes a drive chip 210 and a comparison module 220 connected to the detecting resistor 310 and the drive chip 210 respectively. The comparison module 220 is configured to compare the real-time voltage with the first threshold voltage and the second threshold voltage to obtain a comparison result and to transmit the comparison result to the drive chip 210. It can be understood that the function of the comparison module 220 may be realized by program control or logic circuit elements.

In an embodiment of this disclosure, as shown in FIG. 2, the detecting module 300 further includes an amplifier 320, the detecting resistor 310 is connected to the comparison module 220 by the amplifier 320. Two ends of the detecting resistor 310 are connected to two input terminals of the amplifier 320, respectively. An output terminal of the amplifier 320 is connected to the comparison module 220. It can be understood that in an actual detection process, in order to ensure the sensitivity of detection, the detection resistor 310 will use a relatively small resistance, and the detection module 300 adopts the real-time voltage generated by the output terminals of the amplifier 320, which is convenient for the comparison module 220 to compare.

Figure 3:
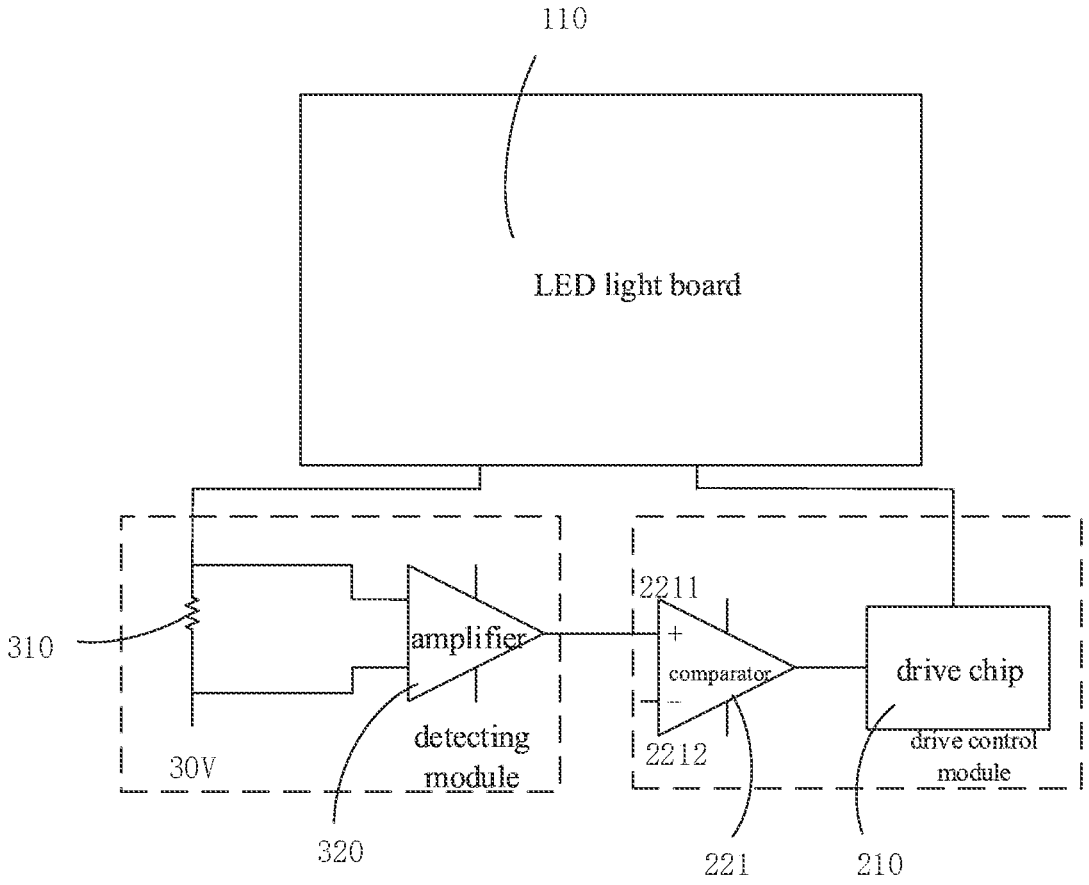
FIG. 3 is a schematic view of a display device according to a third embodiment of the present disclosure.

In an embodiment of this disclosure, as shown in FIG. 3, the first threshold voltage is equal to the second threshold voltage. The comparison module 220 includes a comparator 221. An output terminal of the comparator 221 is connected to the drive chip 210. A first input terminal 2211 of the comparator 221 is connected to the output terminal of the amplifier 320. The first threshold voltage or the second threshold voltage is input into a second input terminal 2212 of the comparator 221. It can be understood that the first input terminal 2211 of the comparator 221 is a "+" input terminal and the second input terminal 2212 of the comparator 221 is a "−" input terminal. After the amplifier 320 outputs the amplified real-time voltage, the second input terminal 2212 of the comparator 221 also inputs a same multiple of the first threshold voltage or the second threshold voltage. When the real-time voltage is greater than the first threshold voltage or the second threshold voltage, the comparator 221 outputs a high level to the drive chip 210, and the drive chip 210 drives the LED light board 110 to display in the low-grayscale cooling display mode according to the high level. When the real-time voltage is less than the first threshold voltage or the second threshold voltage, the comparator 221 outputs a low level to the driving chip 210, and the drive control module 200 drives the LED light board 110 to display in the high-grayscale regular display mode.

Figure 4:
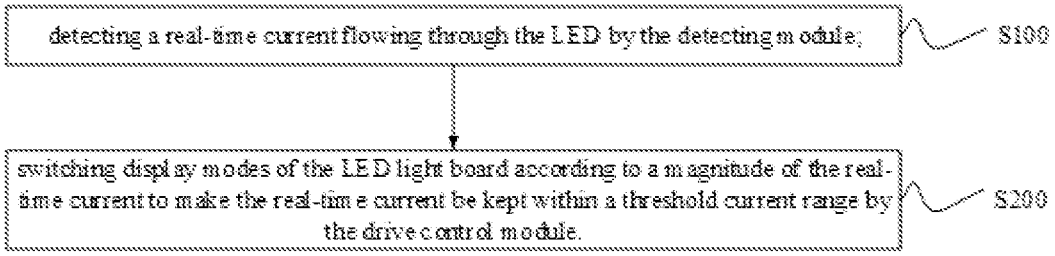
FIG. 4 is a flowchart of a method of driving a display device according to an embodiment of the present disclosure.

The disclosure further provides a method of driving a display device. The display device includes:

display panel 100 including at least one LED light board 110, wherein the display panel 100 includes at least one LED light board 110, and the LED light board 110 includes at least one LED;

a drive control module 200 connected to the LED light board 110, wherein the drive control module 200 is configured to drive the LED of the LED light board 110 to display; and a detecting module 300 respectively connected to the LED light board 110 and the drive control module 200;

Please refer to FIG. 4, the method of driving the display device includes following steps:

Step S100, detecting the real-time current flowing through the LED by the detecting module 300; and Step S200, switching display modes of the LED light board 110 according to the magnitude of the real-time current to keep the real-time current within a threshold current range by the drive control module 200.

It can be understood that the display device detects the real-time current flowing through the LED by the detecting module 300, and switches the display modes of the LED light board 110 according to the magnitude of the real-time current by the drive control module 200 to keep the real-time current within a threshold current range, which avoids the real-time current flowing through the LED caused by high temperature being excessive and leading to a power surge of the mini-LED.

In an embodiment of this disclosure, the display modes of the LED light board 110 include the high-grayscale regular display mode and the low-grayscale cooling display mode. A step of the drive control module 200 switching the display modes of the LED light board 110 according to the magnitude of the real-time current includes:

when the real-time current is greater than a first threshold current, the drive control module 200 driving the LED light board 110 to display in the low-grayscale cooling display mode; and when the real-time current is less than a second threshold current, the drive control module 200 driving the LED light board 110 to display in the high-grayscale regular display mode, wherein the first threshold current is greater than or equal to the second threshold current, the first threshold current is less than a maximum value of the threshold current range, and the second threshold current is less than a minimum value of the threshold current range.

It can be understood that the display modes of the LED light board 110 includes the high-grayscale regular display mode and the low-grayscale cooling display mode. The high-grayscale regular display mode is a normal display mode. When the real-time current is greater than the first threshold current, the drive control module 200 drives the LED light board 110 to display in the low-grayscale cooling display mode, which can reduce an output power of the LED light board 110 and the real-time current flowing through the LED to keep the real-time current within a threshold current range. Keeping the real-time current within the threshold current range can prevent a temperature of the LED from increasing continuously and allow the LED to achieve a certain cooling effect. Obviously, when the temperature of the LED is reduced to a threshold temperature, i.e., the real-time current is less than the second threshold current, the drive control module 200 drives the LED light board 110 to display in the high-grayscale regular display mode, and thus the LED light board 110 returns to a normal display mode. In an embodiment of this disclosure, the high-grayscale regular display mode may be displayed with 64 grayscales, and the low-grayscale cooling display mode may be displayed with 60 grays-scales.

In an embodiment of this disclosure, the detecting module 300 includes a detecting resistor 310 connected to the LED. The drive control module 200 is connected to the two ends of the detecting resistor 310. The drive control module 200 is configured to receive a real-time voltage generated by the real-time current at the two ends of the detection resistor 310, and to switch the display modes of the LED light board 110 according to a magnitude of the real-time voltage.

A step of the drive control module 200 receiving the real-time voltage across the detection resistor 310 and switching the display modes of the LED light board 110 according to the magnitude of the real-time voltage across the detection resistor 310 includes:

when the real-time voltage is greater than the first threshold voltage and the real-time current corresponding to the real-time voltage is greater than the first threshold current, the drive control module 200 driving the LED light board 100 to display in the low-grayscale cooling display mode; and when the real-time voltage is less than a second threshold voltage and the real-time current corresponding to the real-time voltage is less than the second threshold current, the drive control module 200 driving the LED light board 110 to display in the high-grayscale regular display mode, wherein the first threshold voltage is greater than or equal to the second threshold voltage, the first threshold voltage matches with the first threshold current, and the second threshold voltage matches with the second threshold current.

It can be understood that the magnitude of the real-time current can be obtained by detecting the magnitude of the real-time voltage. Therefore, the magnitude of the first threshold voltage can be correspondingly set according to the magnitude of the first threshold current, and thus when the real-time voltage is greater than the first threshold voltage, and the real-time current corresponding to the real-time voltage is greater than the first threshold current, the drive control module 200 can switch the LED light board 110 to display in the low-grayscale cooling display mode, which can reduce an output power of the LED light board 110 and the real-time current flowing through the LED to keep the real-time current within a threshold current range. Keeping the real-time current within a threshold current range can prevent a temperature of the LED from increasing continuously and allow the LED to achieve a certain cooling effect. When the temperature of the LED is reduced to a threshold temperature, the real-time voltage is less than a second threshold voltage, and the real-time current corresponding to the real-time voltage is less than the second threshold current, the drive control module 200 drives the LED light board 110 to display in the high-grayscale regular display mode, and thus the LED light board 110 returns to a normal display mode.

In the display device of the present disclosure, the present application detects the real-time current flowing through the LED through the detection module 300 and switches the display modes of the LED light board 110 according to the magnitude of the real-time current through the drive control module 200, so that the real-time current is kept within a threshold current range, which avoids the real-time current flowing through the LED caused by high temperature being excessive and leading to a power surge of the mini-LED.

The foregoing embodiments are merely some embodiments of the present disclosure, and descriptions thereof are relatively specific and detailed. However, it should not be understood as a limitation to the patent scope of the present disclosure. It should be noted that, a person of ordinary skill in the art may further make some variations and improvements without departing from the concept of the present disclosure, and the variations and improvements belong to the protection scope of the present disclosure. Therefore, the protection scope of the present disclosure shall be subject to the protection scope of the appended claims.

What is claimed is:

1. A display device, comprising:

a display panel, wherein the display panel comprises at least one light-emitting diode (LED) light board, and the LED light board comprises at least one LED;

a drive control module connected to the LED light board, wherein the drive control module is configured to drive the LED of the LED light board to display; and a detecting module respectively connected to the LED light board and the drive control module, wherein the detecting module is configured to detect a real-time current flowing through the LED, and the drive control module is configured to switch display modes of the LED light board according to a magnitude of the real-time current to keep the real-time current within a threshold current range;

wherein the display modes of the LED light board comprise a high-grayscale regular display mode and a low-grayscale cooling display mode; and a step of the drive control module switching the display modes of the LED light board according to the magnitude of the real-time current, comprises:

when the real-time current is greater than a first threshold current, the drive control module driving the LED light board to display in the low-grayscale cooling display mode; and when the real-time current is less than a second threshold current, the drive control module driving the LED light board to display in the high-grayscale regular display mode, wherein the first threshold current is greater than or equal to the second threshold current, the first threshold current is less than a maximum value of the threshold current range, and the second threshold current is less than a minimum value of the threshold current range.

2. The display device in claim 1, wherein the detecting module comprises a detecting resistor connected to the LED, the drive control module is connected to two opposite ends of the detecting resistor, and the drive control module is configured to receive a real-time voltage generated by the real-time current at two ends of the detection resistor and to switch the display modes of the LED light board according to a magnitude of the real-time voltage.

3. The display device in claim 2, wherein a step of the drive control module receiving the real-time voltage generated by the real-time current at the two ends of the detection resistor and switching the display modes of the LED light board according to the magnitude of the real-time voltage comprises:

when the real-time voltage is greater than a first threshold voltage and the real-time current corresponding to the real-time voltage is greater than the first threshold current, the drive control module driving the LED light board to display in the low-grayscale cooling display mode; and when the real-time voltage is less than a second threshold voltage and the real-time current corresponding to the real-time voltage is less than the second threshold current, the drive control module driving the LED light board to display in the high-grayscale regular display mode, wherein the first threshold voltage is greater than or equal to the second threshold voltage, the first threshold voltage matches with the first threshold current, and the second threshold voltage matches with the second threshold current.

4. The display device in claim 3, wherein the drive control module comprises a drive chip and a comparison module connected to the detecting resistor and the drive chip respectively, and the comparison module is configured to compare the real-time voltage with the first threshold voltage and the second threshold voltage to obtain a comparison result and transmit the comparison result to the drive chip.

5. The display device in claim 3, wherein the detecting module further comprises an amplifier, the detecting resistor is connected to the comparison module through the amplifier, two ends of the detecting resistor are respectively connected to two input terminals of the amplifier, and an output terminal of the amplifier is connected to the comparison module.

6. The display device in claim 5, wherein the first threshold voltage is equal to the second threshold voltage, the comparison module comprises a comparator, an output terminal of the comparator is connected to the drive chip, a first input terminal of the comparator is connected to the output terminal of the amplifier, and the first threshold voltage or the second threshold voltage is input into a second input terminal of the comparator.

7. A display device, comprising:

a display panel, wherein the display panel comprises at least one light-emitting diode (LED) light board, and the LED light board comprises at least one LED;

a drive control module connected to the LED light board, wherein the drive control module is configured to drive the LED of the LED light board to display;

a detecting module respectively connected to the LED light board and the drive control module; and a constant voltage control module connected to the LED light board; wherein the detecting module is configured to detect a real-time current flowing through the LED, and the drive control module is configured to switch display modes of the LED light board according to a magnitude of the real-time current to keep the real-time current within a threshold current range;

wherein the display modes of the LED light board comprise a high-grayscale regular display mode and a low-grayscale cooling display mode; and a step of the drive control module switching the display modes of the LED light board according to the magnitude of the real-time current, comprises:

when the real-time current is greater than a first threshold current, the drive control module driving the LED light board to display in the low-grayscale cooling display mode; and when the real-time current is less than a second threshold current, the drive control module driving the LED light board to display in the high-grayscale regular display mode, wherein the first threshold current is greater than or equal to the second threshold current, the first threshold current is less than a maximum value of the threshold current range, and the second threshold current is less than a minimum value of the threshold current range.

8. The display device in claim 7, wherein the detecting module comprises a detecting resistor connected to the LED, the drive control module is connected to two opposite ends of the detecting resistor, the drive control module is configured to receive a real-time voltage generated by the real-time current at the two opposite ends of the detection resistor, and to switch the display modes of the LED light board according to a magnitude of the real-time voltage.

9. The display device in claim 8, wherein a step of the drive control module receiving a real-time voltage generated by the real-time current at the two ends of the detection resistor and switching the display mode of the LED light board according to a magnitude of the real-time voltage comprises:

when the real-time voltage is greater than a first threshold voltage, and the real-time current corresponding to the real-time voltage is greater than the first threshold current, the drive control module driving the LED light board to display in the low-grayscale cooling display mode;

when the real-time voltage is less than a second threshold voltage, and the real-time current corresponding to the real-time voltage is less than the second threshold current, the drive control module driving the LED light board to display in the high-grayscale regular display mode, wherein the first threshold voltage is greater than or equal to the second threshold voltage, the first threshold voltage matches with the first threshold current, and the second threshold voltage matches with the second threshold current.

10. The display device in claim 9, wherein the drive control module comprises a drive chip and a comparison module connected to the detecting resistor and the drive chip respectively, the comparison module is configured to compare the real-time voltage with the first threshold voltage and the second threshold voltage to obtain a comparison result, and to transmit the comparison result to the drive chip.

11. The display device in claim 9, wherein the detecting module further comprises an amplifier, the detecting resistor is connected to the comparison module by the amplifier, two opposite ends of the detecting resistor are respectively connected to two input terminals of the amplifier, and an output terminal of the amplifier is connected to the comparison module.

12. The display device in claim 11, wherein the first threshold voltage is equal to the second threshold voltage, the comparison module comprises a comparator, an output terminal of the comparator is connected to the drive chip, a first input terminal of the comparator is connected to the output terminal of the amplifier, and the first threshold voltage or the second threshold voltage is input into a second input terminal of the comparator.

13. A method of driving a display device, wherein the display device comprises:

a display panel, wherein the display panel comprises at least one light-emitting diode (LED) light board, and the LED light board comprises at least one LED;

a drive control module connected to the LED light board, wherein the drive control module is configured to drive the LED of the LED light board to display; and a detecting module respectively connected to the LED light board and the drive control module, and wherein the method of driving the display device comprises:

detecting a real-time current flowing through the LED by the detecting module; and switching display modes of the LED light board according to a magnitude of the real-time current to keep the real-time current within a threshold current range by the drive control module;

wherein the display modes of the LED light board comprise a high-grayscale regular display mode and a low-grayscale cooling display mode;

a step of switching the display modes of the LED light board according to the magnitude of the real-time current by the drive control module, comprises:

when the real-time current is greater than a first threshold current, the drive control module driving the LED light board to display in the low-grayscale cooling display mode; and when the real-time current is less than a second threshold current, the drive control module driving the LED light board to display in the high-grayscale regular display mode, wherein the first threshold current is greater than or equal to the second threshold current, the first threshold current is less than a maximum value of the threshold current range, and the second threshold current is less than a minimum value of the threshold current range.

14. The method of driving the display device in claim 13, wherein the detecting module comprises a detecting resistor connected to the LED, the drive control module is connected to two ends of the detecting resistor, and the drive control module is configured to receive a real-time voltage generated by the real-time current at the two ends of the detection resistor, and to switch the display modes of the LED light board according to a magnitude of the real-time voltage;

a step of the drive control module receiving a real-time voltage generated by the real-time current at the two opposite ends of the detection resistor and switching the display modes of the LED light board according to the magnitude of the real-time voltage comprises:

when the real-time voltage is greater than a first threshold voltage, and the real-time current corresponding to the real-time voltage is greater than the first threshold current, the drive control module driving the LED light board to display in the low-grayscale cooling display mode; and when the real-time voltage is less than a second threshold voltage, and the real-time current corresponding to the real-time voltage is less than the second threshold current, the drive control module driving the LED light board to display in the high-grayscale regular display mode, wherein the first threshold voltage is greater than or equal to the second threshold voltage, the first threshold voltage matches with the first threshold current, and the second threshold voltage matches with the second threshold current.

* * * * *